United States Patent [19]

Otsuka et al.

[11] 4,375,797

[45] Mar. 8, 1983

[54] AIR/FUEL RATIO FEEDBACK CONTROL SYSTEM FOR INTERNAL COMBUSTION ENGINES

[75] Inventors: Kazuo Otsuka, Higashikurume; Shin Narasaka, Yono; Shumpei Hasegawa, Niiza, all of Japan

[73] Assignee: Honda Giken Kogyo Kabushiki Kaisha, Tokyo, Japan

[21] Appl. No.: 287,872

[22] Filed: Jul. 27, 1981

[30] Foreign Application Priority Data

Aug. 5, 1980 [JP] Japan ..... 55-107976

[51] Int. Cl.[3] ..... F02B 33/00

[52] U.S. Cl. ..... 123/440; 123/489

[58] Field of Search ..... 123/440, 489; 60/276, 60/285

[56] References Cited

U.S. PATENT DOCUMENTS

| | | | |
|---|---|---|---|
| 3,782,347 | 1/1974 | Schmidt et al. | 123/489 |
| 4,153,023 | 5/1979 | Asano et al. | 123/489 |
| 4,231,333 | 11/1980 | Thatcher et al. | 123/440 |
| 4,303,049 | 12/1981 | Ikeura et al. | 123/440 |
| 4,306,523 | 12/1981 | Takeda | 123/440 |

FOREIGN PATENT DOCUMENTS

| | | | |
|---|---|---|---|
| 2652624 | 5/1978 | Fed. Rep. of Germany | 123/489 |
| 56-18044 | 2/1981 | Japan | 123/440 |

*Primary Examiner*—P. S. Lall

*Attorney, Agent, or Firm*—Lyon & Lyon

[57] ABSTRACT

An air/fuel ratio control system which is adapted to perform feedback control of the air/fuel ratio of a mixture being supplied to an internal combustion engine, selectively by porportional term control or by integral term control in response to changes in the output of an $O_2$ sensor. Immediately after changeover from open loop control to closed loop control, the position of an actuator for driving an air/fuel ratio control valve is controlled initially with integral term correction for feedback control of the air/fuel ratio, to thereby keep small the deviation of the actuator position from its proper position immediately after the changeover to the closed loop control.

1 Claim, 5 Drawing Figures

1
2
3
4
5
6
7₁
7₂
8₁
8₂
8₃
8₄
9
10
10a
11
11a
12
13
14
15
16
17
18
20
21
22
23
24
25
26
27
28
29
30₁
30₂
31
32
33
34
35
36
37
38
39
40

AIR/FUEL RATIO FEEDBACK CONTROL SYSTEM FOR INTERNAL COMBUSTION ENGINES

BACKGROUND OF THE INVENTION

This invention relates to an air/fuel ratio feedback control system for performing feedback control of the air/fuel ratio of an air/fuel mixture being supplied to an internal combustion engine, and more particularly to such air/fuel ratio feedback control system which is capable of achieving an accurate air/fuel ratio at an early time after resumption of closed loop or feedback control following open loop control, to thereby ensure high exhaust emission stability of the engine.

An air/fuel ratio feedback control system has already been proposed e.g., by the assignee of the present application, in which an air/fuel ratio control valve is controlled by means of an actuator such as a pulse motor in response to an output signal produced by an exhaust gas ingredient sensor such as an $O_2$ sensor, provided in the exhaust system of an engine, so as to control the air/fuel ratio of an air/fuel mixture being supplied to the engine to a proper value to thereby achieve good engine driveability as well as exhaust emission characteristics.

According to this proposed air/fuel ratio feedback control system, the air/fuel ratio is sometimes not controlled to a proper value if the above air/fuel ratio feedback control based upon the output signal of the $O_2$ sensor is carried out when the engine is in a particular operating condition other than partial load, such as wide-open-throttle, idle, deceleration and off-idle acceleration. Therefore, when the engine comes into such a particular operating condition, the feedback control system is released from its closed loop condition for feedback control of the air/fuel ratio and brought into open loop condition wherein the pulse motor position is moved to and held at a predetermined preset position appropriate for the particular engine operating condition concerned, thus obtaining a proper air/fuel ratio.

On the other hand, when the engine is in a partial load condition, the system is brought into the closed loop condition for feedback control of the air/fuel ratio. In this closed loop condition, proportional term control and integral term control are selectively carried out depending upon changes in the output signal (voltage) of the $O_2$ sensor. More specifically, when the output voltage of the $O_2$ sensor stays at a higher level or at a lower level with respect to a reference voltage, the position of the actuator is controlled with integral term correction in an accurate and stable manner, and when the $O_2$ sensor output voltage changes from the higher level to the lower level or vice versa the actuator position is controlled with proportional term correction in a prompt and efficient manner.

Immediately after transition from open loop control to closed loop control, the pulse motor position must be controlled in immediate response to the output signal level of the $O_2$ sensor to obtain a proper air/fuel ratio. However, there can be a difference in timing between the change of the output signal level of the $O_2$ sensor from the higher level to the lower level or vice versa and the change from open loop mode to closed loop mode. In such an event, the pulse motor position can be largely deviated from its proper position upon entering the closed loop mode, at a rate corresponding to the above timing difference. This results in an improper air/fuel ratio obtained and accordingly unstable exhaust emission of the engine.

OBJECT AND SUMMARY OF THE INVENTION

It is the object of the invention to provide an air/fuel ratio control system for internal combustion engines, which is adapted to initiate feedback control of the actuator position or the air/fuel ratio with integral term control immediately after changeover from open loop control to closed loop control to keep small the deviation of the actuator position from a proper position to thereby achieve accurate air/fuel ratio control at an early time and also obtain highly stable exhaust emission characteristics.

According to the invention, an air/fuel ratio feedback control system for performing feedback control of the air/fuel ratio of an air/fuel mixture being supplied to an internal combustion engine, which comprises an $O_2$ sensor for detecting the concentration of oxygen in exhaust gases emitted from the engine, fuel quantity adjusting means for producing the mixture being supplied to the engine, and an electrical circuit operatively connecting the $O_2$ sensor with the fuel quantity adjusting means in a manner effecting feedback control operation to control the air/fuel ratio of the mixture to a predetermined preset value selectively by proportional term control and by integral term control in response to an output signal produced by the $O_2$ sensor. The electrical circuit is characterized by comprising in combination: a comparator for comparing the value of the output signal of the $O_2$ sensor with a predetermined reference value, a circuit responsive to an output produced by said comparator to produce a first command signal for executing proportional term control upon inversion of the output of the comparator; and a second command signal for executing integral term control when the output of the comparator remains at a certain range level; means for detecting predetermined operating conditions of the engine; means responsive to an output of the detecting means indicative of the occurrence of one of the predetermined operating conditions of the engine to interrupt the feedback control operation; and means responsive to an output of the detecting means indicative of the extinction of the above predetermined engine operating condition to cause the above command signal output circuit to produce the second command signal.

The above and other objects, features and advantages of the invention will be more apparent from the ensuing detailed description taken in connection with the accompanying drawings in which:

DETAILED DESCRIPTION

The air/fuel ratio feedback control system according to the invention will now be described in detail with reference to the accompanying drawings wherein an embodiment of the invention is illustrated.

Figure 1:
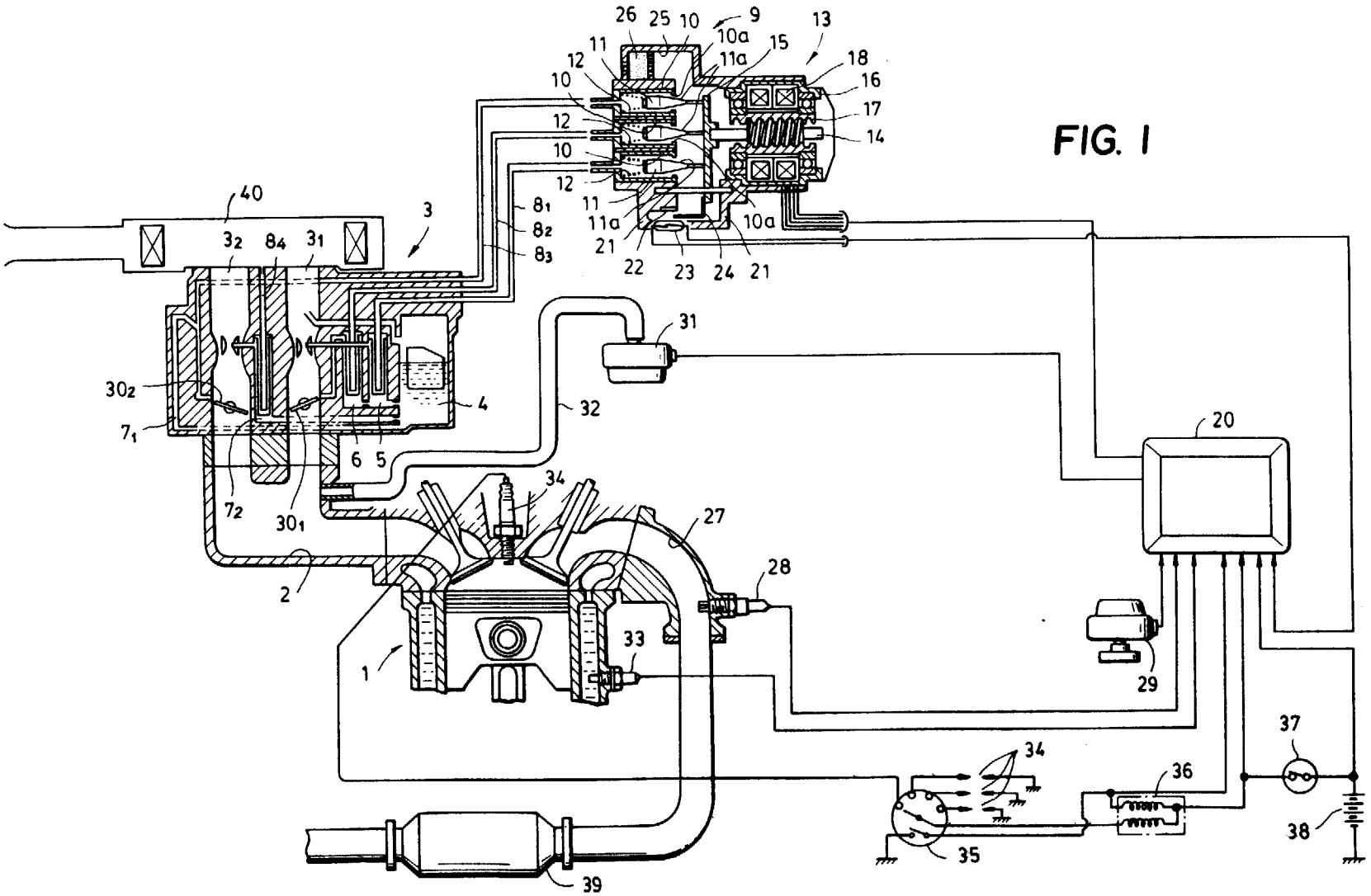
FIG. 1 is a diagrammatic view illustrating an air/fuel ratio feedback control system according to the present invention.

Referring now to FIG. 1, there is illustrated the whole system of the invention. Reference numeral 1 designates an internal combustion engine. Connected to the engine 1 is an intake manifold 2 which is provided with a carburetor generally designated by the numeral 3. The carburetor 3 has fuel passages 5, 6 which communicate a float chamber 4 with the primary bore $3_1$ of the carburetor 3. These fuel passages 5, 6 are connected to an air/fuel ratio control valve generally designated by the numeral 9, via air bleed passages $8_1$, $8_2$. The carburetor 3 also has fuel passages $7_1$, $7_2$ communicating the float chamber 4 with the secondary bore $3_2$ of the carburetor 3. The fuel passage $7_1$, on one hand, is connected to the above air/fuel ratio control valve 9 via an air passage $8_3$ and, on the other hand, opens in the secondary bore $3_2$ at a location slightly upstream of a throttle valve $30_2$ in the secondary bore. The fuel passage $7_2$ communicates with the interior of an air cleaner 40 via an air passage $8_4$ having a fixed orifice. The control valve 9 is comprised of three flow rate control valves, each of which is formed of a cylinder 10, a valve body 11 displaceably inserted into the cylinder 10, and a coil spring 12 interposed between the cylinder 10 and the valve body 11 for urging the valve body 11 in a predetermined direction. Each valve body 11 is tapered along its end portion 11*a* remote from the coil spring 12 so that the effective opening area of the opening 10*a* of each cylinder 10, in which the tapered portion 11*a* of the valve body is inserted, varies as the valve body 11 is moved. Each valve body 11 is disposed in urging contact with a connection plate 15 coupled to a worm element 14 which is axially movable but not rotatable about its own axis. The worm element 14 is in threaded engagement with the rotor 17 of a pulse motor 13 which is arranged about the element 14 and rotatably supported by radial bearings 16. Arranged about the rotor 17 is a solenoid 18 which is electrically connected to an electronic control unit (hereinafter called "ECU") 20. The solenoid 18 is energized by driving pulses supplied from ECU 20 to cause rotation of the rotor 17 which in turn causes movement of the worm element 14 threadedly engaging the rotor 17 in the leftward and rightward directions as viewed in FIG. 1. Accordingly, the connection plate 15 coupled to the worm element 14 is moved leftward and rightward in unison with the movement of the worm element 14.

The pulse motor 13 has its stationary housing 21 provided with a permanent magnet 22 and a reed switch 23 arranged opposite to each other. The plate 15 is provided at its peripheral edge with a magnetic shielding plate 24 formed of a magnetic material which is interposed between the permanent magnet 22 and the reed switch 23 for movement into and out of the gap between the two members 22, 23. The magnetic shielding plate 24 is displaced in the leftward and rightward directions in unison with displacement of the plate 15 in the corresponding directions. The reed switch 23 turns on or off in response to the displacement of the plate 24. That is, when the valve body 11 of the air/fuel ratio control valve 9 passes a reference position which is determined by the positions of the permanent magnet 22, reed switch 23 and magnetic shielding plate 24, the reed switch 23 turns on or off depending upon the moving direction of the valve body 11, to supply a corresponding binary output signal to ECU 20.

Incidentally, the pulse motor housing 21 is formed with an air intake 25 communicating with the atmosphere. Air is introduced through a filter 26 mounted in the air intake 25, into each flow rate control valve in the housing 21.

On the other hand, an $O_2$ sensor 28, which is made of zirconium oxide or the like, is inserted in the inner peripheral wall of the exhaust manifold 27 of the engine 1 in a manner partly projecting in the manifold 27. The sensor 28 is connected to ECU 20 to supply its output thereto. An atmospheric pressure sensor 29 is provided to detect the ambient atmospheric pressure surrounding the vehicle, not shown, in which the engine 1 is installed. The sensor 29 is also connected to ECU 20 to supply its output thereto.

Incidentally, in FIG. 1, reference numeral 39 designates a three-way catalyst for purifying CO, HC and NOx present in the engine exhaust gases, 31 a pressure sensor arranged to detect the absolute pressure in the intake manifold 2 at a zone downstream of the throttle valves $30_1$, $30_2$ through a conduit 32, the sensor 31 being connected to ECU 20 to supply its output thereto, and 33 a thermistor partly inserted in the peripheral wall of the engine 1, the interior of which is filled with engine cooling water, to detect the temperature of the cooling water as an engine temperature, the sensor 33 being also connected to ECU 20 to supply its output thereto, respectively. Reference numeral 34 denotes an ignition plug embedded in the cylinder head of the engine 1 with its tip projected in the combustion chamber, 35 a distributor, 36 an ignition coil, 37 an ignition switch and 38 a battery, respectively. The distributor 35 has a drive shaft, now shown, arranged to be rotated at speeds proportional to the engine rpm so that the ignition coil 36 produces pulses corresponding in frequency to switching of the contact point of the distributor 35 or an output signal produced by a contactless pickup alternatively provided. The ignition coil 36 is connected to ECU 20 to supply its output pulses thereto. Thus, the distributor 35 and the ignition coil 36 also serve as an engine rpm sensor in the illustrated embodiment.

Details of the air/fuel ratio control which can be performed by the air/fuel ratio feedback control system of the invention described above will now be described with reference to FIG. 1 which is referred to hereinabove.

Initialization

Referring first to the initialization, when the ignition switch 37 in FIG. 1 is set on at the start of the engine, ECU 20 is initialized to detect the reference position of the actuator or pulse motor 13 by means of the reed switch 23 and hence drive the pulse motor 13 to set it to its best position (a preset position) for starting the engine, that is, set the initial air/fuel ratio to a predetermined proper value. The above preset position of the pulse motor 13 is hereinafter called "$PS_{CR}$". This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 13 is detected as the position at which the reed switch 23 turns on or off, as previously mentioned with reference to FIG. 1.

Then, ECU 20 monitors the condition of activation of the $O_2$ sensor 28 and the coolant temperature Tw detected by the thermistor 33 to determine whether or not the engine is in a condition for initiation of the air/fuel ratio control. For accurate air/fuel ratio feedback control, it is a requisite that the $O_2$ sensor 28 is fully activated and the engine is in a warmed-up condition. The $O_2$ sensor 28, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 20, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions are fulfilled that the sensor produces an activation signal when its output voltage lowers down to a predetermined voltage Vx, a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 13 is held at its predetermined position $PS_{CR}$. The pulse motor 13 is driven to appropriate positions in response to the operating condition of the engine after initiation of the air/fuel ratio control, as hereinlater described.

Basic Air/Fuel Ratio Control

Following the initialization, the program proceeds to the basic air/fuel ratio control.

ECU 20 is responsive to various detected value signals representing the output voltage of the $O_2$ sensor 28, the absolute pressure in the intake manifold 2 detected by the pressure sensor 31, the engine rpm Ne detected by the rpm sensor 35, 36, and the atmospheric pressure $P_A$ detected by the atmospheric pressure sensor 29, to drive the pulse motor 13 as a function of these signals to control the air/fuel ratio. More specifically, the basic air/fuel ratio control comprises open loop control which is carried out at wide-open-throttle, at engine idle, and at engine deceleration, and closed loop control which is carried out at engine partial load. All the control is initiated after completion of the warming-up of the engine.

First, the condition of open loop control at wide-open-throttle is met when the differential pressure $P_A - P_B$ (gauge pressure) between the absolute pressure $P_B$ detected by the pressure sensor 31 and the atmospheric pressure $P_A$ (absolute pressure) detected by the atmospheric pressure sensor 29 is lower than a predetermined value $\Delta P_{WOT}$. ECU 20 compares the difference in value between the output signals of the sensors 29, 31 with the predetermined value $\Delta P_{WOT}$ stored therein, and when the relationship of $P_A - P_B < \Delta P_{WOT}$ stands, drives the pulse motor 13 to a predetermined position (preset position) $PS_{WOT}$ and holds it there, which is a position best appropriate for the engine emissions to be obtained at the time of termination of the wide-open-throttle open loop control. At wide-open-throttle, a known economizer, not shown, or the like is actuated to supply a rich or small air/fuel ratio mixture to the engine.

The condition of open loop control at engine idle is met when the engine rpm Ne is lower than a predetermined idle rpm $N_{IDL}$ (e.g., 1,000 rpm). ECU 20 compares the output signal value Ne of the rpm sensor 35, 36 with the predetermined rpm $N_{IDL}$ stored therein, and when the relationship of $Ne < N_{IDL}$ stands, drives the pulse motor 13 to a predetermined idle position (preset position) $PS_{IDL}$ which is best suitable for the engine emissions and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold is lower than a predetermined value $PB_{DEC}$. ECU 20 compares the output signal value $P_B$ of the pressure sensor 31 with the predetermined value $PB_{DEC}$ stored therein, and when the relationship of $P_B < PB_{DEC}$ stands, drives the pulse motor 13 to a predetermined deceleration position (preset position) $PS_{DEC}$ best suitable for the engine emissions and holds it there.

The ground for this condition of open loop control at engine deceleration lies in that when the absolute pressure $P_B$ in the intake manifold drops below the predetermined value, unburned HC is produced at an increased rate in the exhaust gases, to make it impossible to carry out the air/fuel ratio feedback control based upon the detected value signal of the $O_2$ sensor with accuracy, thus failing to control the air/fuel ratio to a theoretical value. Therefore, according to the invention, the open loop control is employed, as noted above, when the absolute pressure $P_B$ in the intake manifold detected by the pressure sensor 31 is smaller than the predetermined value $PB_{DEC}$, where the pulse motor is set to the predetermined position $PS_{DEC}$ best suitable for the engine emissions obtained at the time of termination of the deceleration open loop control.

During operations of the above-mentioned open loop control at wide-open-throttle, at engine idle, at engine deceleration, the respective predetermined positions $PS_{WOT}$, $PS_{IDL}$, $PS_{DEC}$ for the pulse motor 13 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 20 performs selectively feedback control based upon proportional term correction (hereinafter called "P term control") and feedback control based upon integral term correction (hereinafter called "I term control"), in response to the engine rpm Ne detected by the engine rpm sensor 35, 36 and the output signal of the $O_2$ sensor 28. To be concrete, the integral term correction is used when the output voltage of the $O_2$ sensor 28 varies only at the higher level side or only at the lower level side with respect to a reference voltage Vref, wherein the position of the pulse motor 13 is corrected by an integral value obtained by integrating the value of a binary signal which changes in dependence on whether the output voltage of the $O_2$ sensor is at the higher level or at the lower level with respect to the predetermined reference voltage Vref, to thereby achieve stable and accurate position control of the pulse motor 13. On the other hand, when the output signal of the $O_2$ sensor changes from the higher level to the lower level or vice versa, the proportional term correction is carried out wherein the position of the pulse motor 13 is corrected by a value directly proportional to a change in the output voltage of the $O_2$ sensor to thereby achieve air/fuel ratio control in a manner prompter and more efficient than the integral term correction.

As noted above, according to the above I term control, the pulse motor position is varied by an integral value by integrating the value of a binary signal corresponding to the change of the output voltage of the $O_2$ sensor. According to this I term control, the number of steps by which the pulse motor is to be displaced per second differs depending upon the speed at which the engine is then operating. That is, in a low engine rpm range, the number of steps by which the pulse motor is to be displaced is small. With an increase in the engine rpm, the above number of steps increases so that it is large in a high engine rpm range.

Whilst, according to the P term control which, as noted above, is used when there is a change in the output voltage of the $O_2$ sensor from the higher level to the lower one or vice versa with respect to the reference voltage Vref, the number of steps by which the pulse motor is to be displaced per second is set at a single predetermined value (e.g., 6 steps), irrespective of the engine rpm.

The air/fuel ratio control at engine acceleration (i.e., off-idle acceleration) is carried out when the engine rpm Ne exceeds the aforementioned predetermined idle rpm $N_{IDL}$ (e.g., 1,000 rpm) during the course of the engine speed increasing from a low rpm range to a high rpm range, that is, when the engine speed changes from a relationship $Ne < N_{IDL}$ to one $Ne \geqq N_{IDL}$. On this occasion, ECU 20 rapidly moves the pulse motor 13 to a predetermined acceleration position (preset position) $PS_{ACC}$, and thereafter initiates the aforementioned air/fuel ratio feedback control. This predetermined position $PS_{ACC}$ is compensated for atmospheric pressure $P_A$, too, as hereinlater described.

The above-mentioned predetermined position $PS_{ACC}$ is set at a position where the amount of detrimental ingredients in the exhaust gases is small. Therefore, particularly at the so-called "standing start", i.e., acceleration from a vehicle-stopping position, setting the pulse motor position to the predetermined position $PS_{ACC}$ is advantageous to anti-exhaust measures, as well as to achievement of accurate air/fuel ratio feedback control to be done following the acceleration. This acceleration control is carried out under a warmed-up engine condition, too. By thus setting the pulse motor to the preset position $PS_{ACC}$ at the standing start of the engine, it is feasible to reduce the amount of detrimental ingredients in the engine exhaust gases to be produced at the standing start. Further, this setting of the pulse motor position automatically determines the initial air/fuel ratio to be applied at the start of air/fuel ratio feedback control immediately following this standing start to thereby facilitate control of the air/fuel ratio to an optimum value for the emission characteristics and driveability of the engine at the start of air/fuel ratio feedback control.

Particularly, the above manner of control at engine acceleration enables a large reduction in the total amount of detrimental ingredients in the exhaust gases to be produced during transition from the standing start to the immediately following air/fuel ratio feedback operation, thus being advantageous to the anti-pollution measures.

In transition from the above-mentioned various open loop control to the closed loop control at engine partial load or vice versa, changeover between open loop mode and closed loop mode is effected in the following manner: First, in changing from closed loop mode to open loop mode, ECU 20 moves the pulse motor 13 to an atmospheric pressure-compensated predetermined position $PSi(P_A)$ in a manner referred to later, irrespective of the position at which the pulse motor was located immediately before entering the open loop control. This predetermined position $PSi(P_A)$ includes preset positions $PS_{CR}$, $PS_{WOT}$, $PS_{IDL}$, $PS_{DEC}$ and $PS_{ACC}$, each of which is corrected in response to actual atmospheric pressure as hereinlater referred to. Various open loop control operations can be promptly done, simply by setting the pulse motor to the above-mentioned respective predetermined positions.

On the other hand, in changing from open loop mode to closed loop mode, ECU 20 commands the pulse motor 13 to initiate air/fuel ratio feedback control with I term correction. That is, there can be a difference in timing between the change of the output signal level of the $O_2$ sensor from the high level to the low level or vice versa and the change from the open loop mode to the closed loop mode. In such an event, the deviation of the pulse motor position from the proper position upon entering the closed loop mode, which is due to such timing difference, is much smaller in the case of initiating air/fuel ratio control with I term correction than that in the case of initiating it with P term correction, to make it possible to resume early accurate air/fuel ratio control and accordingly ensure highly stable engine exhaust emission characteristics.

An example of the manner of initiation of the feedback control in closed loop mode will now be described with reference to FIGS. 2A and 2B where the engine is accelerated in closed loop mode from an idle condition in open loop mode. This example is given on the assumption that the air/fuel ratio during the idle operation is maintained at a constant value on the lean or large air/fuel ratio side. Examples of change of the output voltage V of the $O_2$ sensor 28 at the transition from the idle condition to the accelerated condition are shown in part (a) of FIG. 2A and part (a) of FIG. 2B. In each of these figures, there are plotted in part (i) output voltages of the $O_2$ sensor obtained at the idle, and in part (ii) those at the acceleration, respectively, wherein symbols O and X represent two groups of output voltages of the $O_2$ sensor produced with different timing with respect to the timing of the changeover from open loop mode to closed loop mode (the changeover time is indicated by the vertical broken line). Generally speaking, at engine acceleration, the mixture often becomes rich due to the action of the acceleration pump of the accelerating system of the carburetor. Therefore, also in the examples of FIG. 2A (a) and FIG. 2B (b), it is noted that the output voltage of the $O_2$ sensor is changed from the low level Lo at the open loop control (i) into the high level Hi at the closed loop acceleration control (ii).

Figure 2A:
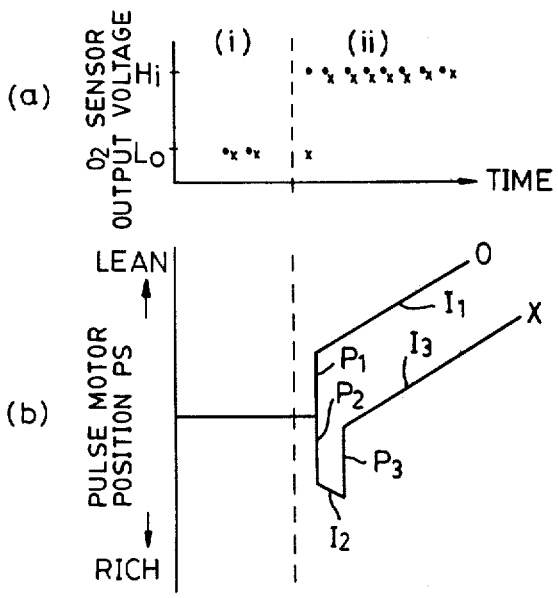
FIG. 2A is a graph showing the relationship between the timing of change of the output voltage of the $O_2$ sensor and the pulse motor position, which is obtainable when the closed loop control is initiated with proportional term control.
Figure 2B:
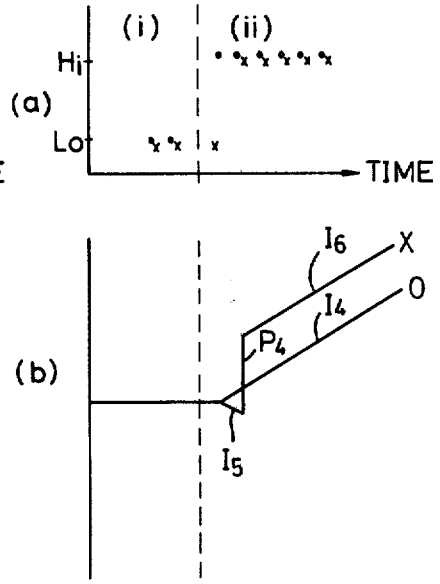
FIG. 2B is a graph similar to the graph of FIG. 2A, showing the above relationship obtainable when the closed loop control is initiated with integral term control.

In part (b) of each of FIGS. 2A and 2B there are plotted two traces of the pulse motor position PS obtained at the changeover from open loop mode to closed loop mode, one of the traces being obtained when the closed loop control is initiated with P term correction and the other with I term correction, respectively. Reference is first made to the example of initiation of the closed loop control with P term correction. According to the example of change of the $O_2$ sensor output voltage indicated by the symbol O in FIG. 2A (a), the $O_2$ sensor output voltage V is changed into the Hi side immediately after the changeover to closed loop mode and consequently the pulse motor is driven toward the lean side by P term correction along the line $P_1$ as shown in FIG. 2A (b). Then, the output voltage V then remains on the Hi side (FIG. 2A (a)), and accordingly the pulse motor is hence driven along the line $I_1$ by I term correction. On the other hand, according to the example of change of the $O_2$ sensor output voltage V indicated by the symbol X in FIG. 2A (a), the output voltage V is still on the Lo side immediately after the changeover to closed loop mode so that the pulse motor is driven toward the rich side along the line $P_2$ by P term correction and then along the line $I_2$ by I term correction. Then, the output voltage V is changed from the Lo side to the Hi side so that the pulse motor is hence driven toward the lean side along the line $P_3$ by P term correction. It is further driven toward the same side along the line $I_3$ by I term correction in accordance with the stay of the output voltage V on the Hi side.

Reference is now made to FIG. 2B (b) showing an example of the method according to the present invention where the feedback control is initiated with P term correction immediately after the changeover to closed loop mode. According to the example of change of the output voltage V indicated by the symbol O in FIG. 2B (a), it is noted that the output voltage V is changed into the rich or Hi side immediately after the changeover to closed loop mode and hence stays on the same side. Accordingly, the pulse motor is driven toward the lean side consecutively by I term correction. Whilst, according to the example of change of the output voltage V indicated by the symbol X in FIG. 2B (a), the output voltage V still remains on the lean or Lo side immediately after the changeover to closed loop mode so that the pulse motor is driven toward the rich side along the line $I_5$ by I term correction as shown in FIG. 2B (b). Then, the output voltage V changes from the Lo side to the Hi side, and accordingly the pulse motor is driven toward the lean side along the line $P_4$ by P term correction. Thereafter, the output voltage V remains on the Hi side, so that the pulse motor is driven toward the lean side along the line $I_6$ by I term correction.

It will be explicit from FIGS. 2A (b) and 2B (b) that the difference in the pulse motor position due to the difference in the timing of change of the output voltage is much smaller in the case of initiating the closed loop control when I term correction than in the case of initiating it with P term correction.

To obtain optimum exhaust emission characteristics irrespective of changes in the actual atmospheric pressure during open loop air/fuel ratio control or at the time of shifting from open loop mode to closed loop mode, the position of the pulse motor 13 needs to be compensated for atmospheric pressure, as previously mentioned. According to the invention, the above-mentioned predetermined or preset positions $PS_{CR}$, $PS_{WOT}$, $PS_{IDL}$, $PS_{DEC}$, $PS_{ACC}$ at which the pulse motor 13 is to be held during the respective open loop control operations are corrected in a linear manner as a function of changes in the atmospheric pressure $P_A$, using the following equation:

$$PSi(P_A) = PSi + (760 - P_A) \times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 20.

ECU 20 applies to the above equation the coefficients PSi, Ci which are determined at proper different values according to the kinds of open loop control to be carried out, to calculate by the above equation the position $PSi(P_A)$ for the pulse motor 13 to be set at a required kind of open loop control and moves the pulse motor 13 to the calculated position $PSi(P_A)$, as described in detail hereinlater.

By correcting the air/fuel ratio during open loop control in response to the actual atmospheric pressure in the above-mentioned manner, it is possible to obtain not only conventionally known effects such as best driveability and prevention of burning of the ignition plug in an engine cylinder, but also optimum emission characteristics by setting the value of Ci at a suitable value, since the pulse motor position held during open loop control forms an initial position upon entering subsequent closed loop control.

The position of the pulse motor 13 which is used as the actuator for the air/fuel ratio control valve 9 is monitored by a position counter provided within ECU 20. However, there can occur a disagreement between the counted value of the position counter and the actual position of the pulse motor due to skipping or racing of the pulse motor. In such an event, ECU 20 operates on the counted value of the position counter as if it were the actual position of the pulse motor 13. However, this can impede proper setting of the air/fuel ratio during open loop control where the actual position of the pulse motor 13 must be accurately recognized by ECU 20.

In view of the above disadvantage, as previously mentioned, according to the air/fuel ratio control system of the invention, in addition to detection of the initial position of the pulse motor 13 by regarding as the reference position (e.g., 50th step) the position of the pulse motor at which the reed switch 23 turns on or off when the pulse motor is driven, which was previously noted with reference to the initialization in FIG. 2, the position counter has its counted value replaced by the number of steps corresponding to the reference position (e.g., 50 steps) stored in ECU 20 upon the pulse motor 13 passing the switching point of the reed switch 23, to thus ensure high reliability of subsequent air/fuel ratio control.

Figure 3:
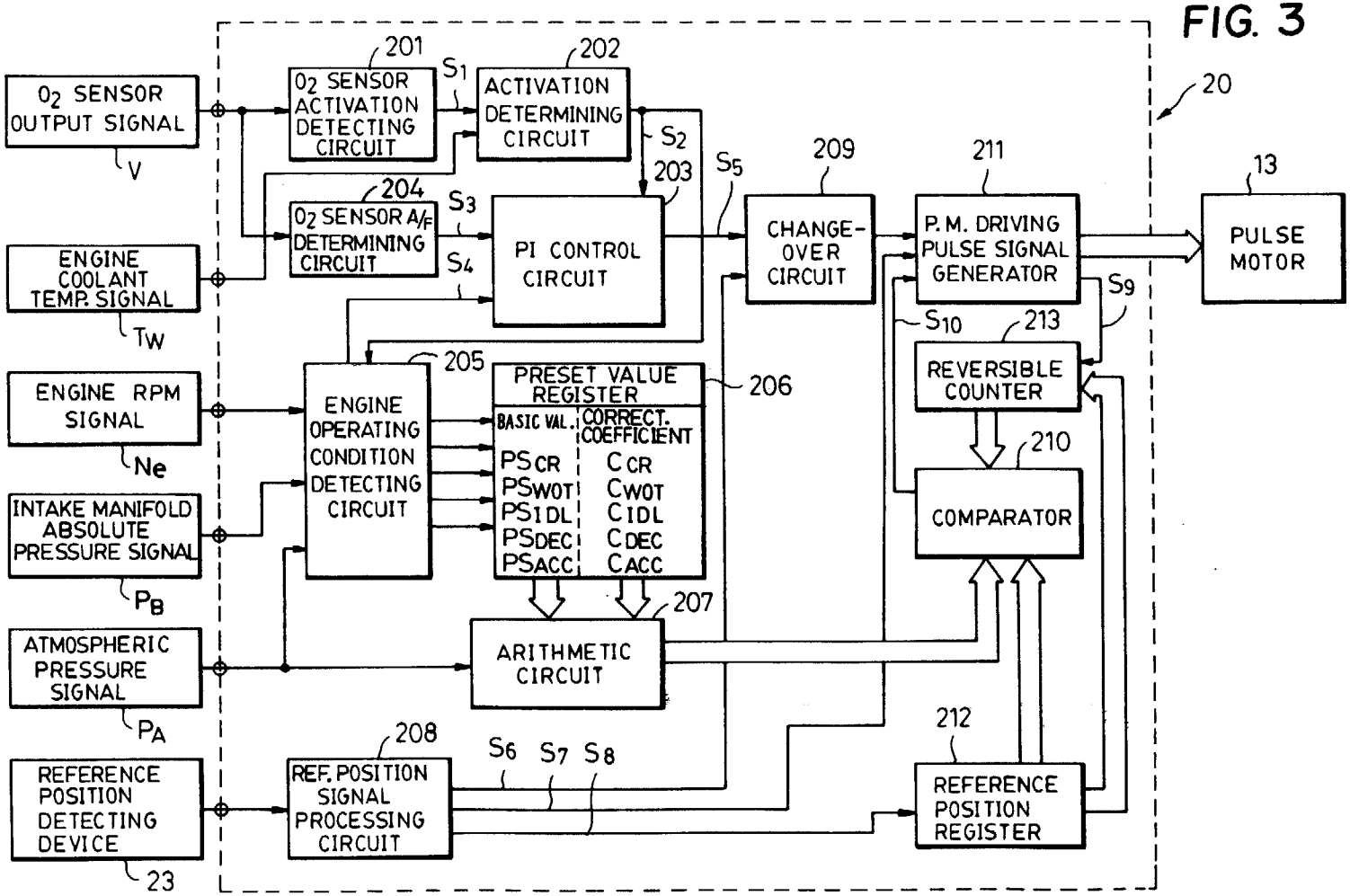
FIG. 3 is a block diagram illustrating as a whole an electrical circuit provided within an electronic control unit in FIG. 1.

FIG. 3 is a block diagram illustrating the interior construction of ECU 20 used in the air/fuel ratio control system having the above-mentioned functions according to the invention. In ECU 20, reference numeral 201 designates a circuit for detecting the activation of the $O_2$ sensor 28, which is supplied at its input with an output signal V from the $O_2$ sensor. Upon passage of the predetermined period of time Tx after the voltage of the above output signal V has dropped below the predetermined value Vx, the above circuit 201 supplies an activation signal $S_1$ to an activation determining circuit 202. This activation determining circuit 202 is also supplied at its input with an engine coolant temperature signal Tw from the thermistor 33 in FIG. 1. When supplied with both the above activation signal $S_1$ and the coolant temperature signal Tw indicative of a value exceeding the predetermined value Twx, the activation determining circuit 202 supplies an air/fuel ratio control initiation signal $S_2$ to a PI control circuit 203 to render same ready to operate. Reference numeral 204 represents an air/fuel ratio determining circuit which determines the value of air/fuel ratio of engine exhaust gas, depending upon whether or not the output voltage of the $O_2$ sensor is larger than the predetermined value Vref, to supply a binary signal $S_3$ indicative of the value of air/fuel ratio thus obtained, to the PI control circuit 203. On the other hand, an engine condition detecting circuit 205 is provided in ECU 20, which is supplied with an engine rpm signal Ne from the engine rpm sensor 35, 36, an absolute pressure signal $P_B$ from the pressure sensor 31, an atmospheric pressure signal $P_A$ from the atmospheric pressure sensor 29, all the sensors being shown in FIG. 1, and the above control initiation signal $S_2$ from the activation determining circuit 202 in FIG. 3, respectively. The circuit 205 supplies a control signal $S_4$ indicative of a value corresponding to the values of the above input signals to the PI control circuit 203. The PI control circuit 203 accordingly supplies to a change-over circuit 209 to be referred to later a pulse motor control signal $S_5$ having a value corresponding to the air/fuel ratio signal $S_3$ from the air/fuel ratio determining circuit 204 and a signal component corresponding to the engine rpm Ne in the control signal $S_4$ supplied from the engine condition detecting circuit 205. The engine condition detecting circuit 205 also supplies to the PI control circuit 203 the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine condition detecting circuit 205, the PI control circuit 203 interrupts its own operation. Upon interruption of the supply of the above signal component to the control circuit 203, a pulse signal $S_5$ is outputted from the circuit 203 to the change-over circuit 209, which signal starts air/fuel ratio control with integral term correction.

On the other hand, a preset value register 206 is provided in ECU 20, in which are stored the basic values of preset values $PS_{CR}$, $PS_{WOT}$, $PS_{IDL}$, $PS_{DEC}$ and $PS_{ACC}$ for the pulse motor position, applicable to various engine conditions, and atmospheric pressure correcting coefficients $C_{CR}$, $C_{WOT}$, $C_{IDL}$, $C_{DEC}$ and $C_{ACC}$ for these basic values. The engine condition detecting circuit 205 detects the operating condition of the engine based upon the activation of the $O_2$ sensor and the values of engine rpm Ne, intake manifold absolute pressure $P_B$ and atmospheric pressure $P_A$ to read from the register 206 the basic value of a preset value corresponding to the detected operating condition of the engine and its corresponding correcting coefficient and apply same to an arithmetic circuit 207. The arithmetic circuit 207 performs arithmetic operation responsive to the value of the atmospheric pressure signal $P_A$, using the equation $PSi(P_A)=PSI+(760-P_A)\times Ci$. The resulting preset value is applied to a comparator 210.

On the other hand, a reference position signal processing circuit 208 is provided in ECU 20, which is responsive to the output signal of the reference position detecting device (reed switch) 23, indicative of the switching of same, to produce a binary signal $S_6$ having a certain level from the start of the engine until it is detected that the pulse motor reaches the reference position. This binary signal $S_6$ is supplied to the change-over circuit 209 which in turn keeps the control signal $S_5$ from being transmitted from the PI control circuit 203 to a pulse motor driving signal generator 211 as long as it is supplied with this binary signal $S_6$, thus avoiding the interference of the operation of setting the pulse motor to the initial position with the operation of P-term/I-term control. The reference position signal processing circuit 208 also produces a pulse signal $S_7$ in response to the output signal of the reference position detecting device 23, which signal causes the pulse motor 13 to be driven in the step-increasing direction or in the step-decreasing direction so as to detect the reference position of the pulse motor 13. This signal $S_7$ is supplied directly to the pulse motor driving signal generator 211 to cause same to drive the pulse motor 13 until the reference position is detected. The reference position signal processing circuit 208 produces another pulse signal $S_8$ each time the reference position is detected. This pulse signal $S_8$ is supplied to a reference position register 212 in which the value of the reference position (e.g., 50 steps) is stored. This register 212 is responsive to the above signal $S_8$ to apply its stored value to one input terminal of the comparator 210 and to the input of a reversible counter 213. The reversible counter 213 is also supplied with an output pulse signal $S_9$ produced by the pulse motor driving signal generator 211 to count the pulses of the signal $S_9$ corresponding to the actual position of the pulse motor 13. When supplied with the stored value from the reference position register 212, the counter 213 has its counted value replaced by the value of the reference position of the pulse motor.

The counted value thus renewed is applied to the other input terminal of the comparator 210. Since the comparator 210 has its other input terminal supplied with the same pulse motor reference position value, as noted above, no output signal is supplied from the comparator 210 to the pulse motor driving signal generator 211 to thereby hold the pulse motor at the reference position with certainty. Subsequently, when the $O_2$ sensor 28 remains deactivated, an atmospheric pressure-compensated preset value $PS_{CR}(P_A)$ is outputted from the arithmetic circuit 207 to the one input terminal of the comparator 210 which in turn supplies an output signal $S_{10}$ corresponding to the difference between the preset value $PS_{CR}(P_A)$ and a counted value supplied from the reversible counter 213, to the pulse motor driving signal generator 211, to thereby achieve accurate control of the position of the pulse motor 13. Also, when the other open loop control conditions are detected by the engine condition detecting circuit 205, similar operations to that just mentioned above are carried out.

Figure 4:
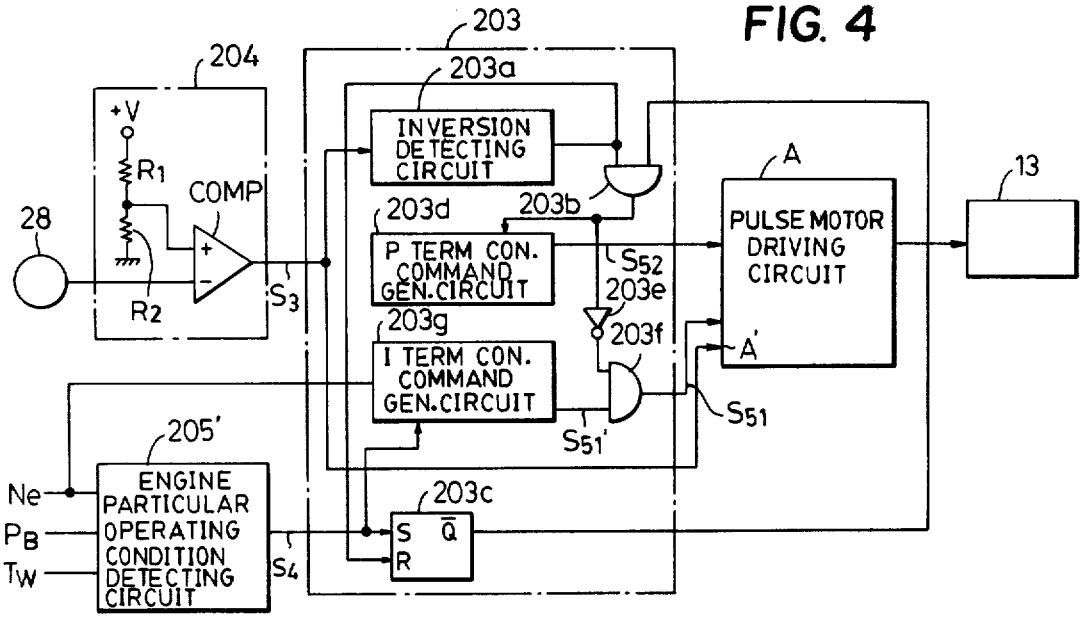
FIG. 4 is a block diagram illustrating a circuit arrangement for control of the changeover between the open loop control and the closed loop control, forming part of the electrical circuit of FIG. 3.

FIG. 4 is a block diagram illustrating a device provided in the aforedescribed air/fuel ratio feedback control system of the invention for initiating the air/fuel ratio feedback control with I term correction upon the changeover from open loop mode to closed loop mode.

The output of the $O_2$ sensor 28 in FIG. 1 is connected to the inverting input terminal of a comparator COMP which in turn has its non-inverting input terminal connected to the junction of a resistance $R_1$ with a resistance $R_2$. The resistances $R_1$ and $R_2$ are connected in series between a suitable positive voltage power supply, not shown, and the ground to supply a reference voltage Vref to the comparator COMP through their junction. The comparator COMP and the resistances $R_1$, $R_2$ form the $O_2$ sensor air/fuel ratio determining circuit 204 in FIG. 3. The comparator COMP is arranged to supply its output signal to an inversion detecting circuit 203*a* which is arranged within the PI control circuit 203 in FIG. 3 and adapted to produce an output pulse each time the output of the comparator COMP is inverted. Further, the output signal of the comparator COMP is supplied to one input terminal A' of a pulse motor driving circuit A which forms the change-over circuit 209 and pulse motor driving signal generator 211 in FIG. 3. The above circuit A is adapted to determine the driving direction of the pulse motor depending upon the input applied to its input terminal A'. In the interior of PI control circuit 203, the inversion detecting circuit 203*a* has its output connected, on one hand, to one input terminal of an AND circuit 203*b* and, on the other hand, to the R-input terminal of a flip flop circuit 203*c*. The AND circuit 203*b* has its other input terminal connected to the $\overline{Q}$-output terminal of the flip flop circuit 203*c*. The AND circuit 203*b* has its output connected, on one hand, to the input of a P term control command generating circuit 203*d*, and on the other hand, to one input terminal of an AND circuit 203*f* by way of an inverter 203*e*. The AND circuit 203*f* has its other input terminal connected to the output of an I term control command generating circuit 203*g*. The P term control command generating circuit 203*d* and the AND circuit 203*f* have their outputs connected to the pulse motor driving circuit A. On the other hand, the flip flop circuit 203*c* has its S-input terminal connected to the output of a circuit 205' which forms part of the engine operating condition detecting circuit 205 in FIG. 3 and is adapted to detect the aforementioned particular operating conditions of the engine on the basis of the engine rpm signal Ne, the engine absolute pressure signal $P_B$ and the engine cooling water temperature signal Tw. The circuit 205' has its output also connected to the I term control command generating circuit 203*g*.

The operation of the device of FIG. 4 constructed above will now be described. First, when the engine comes into one of the particular operating conditions, the particular engine operating condition detecting circuit 205' detects this particular operating condition from the values of the rpm signal Ne, the absolute pressure signal $P_B$ and the cooling water temperature signal Tw and supplies a binary output $S_4$ of 1 to the S-input terminal of the flip flop circuit 203*c*. This signal $S_4$ of 1 is simultaneously applied as a feedback control interrupting signal to the I term control command generating circuit 203*g* to interrupt the operation of the same. On the other hand, when set by the signal $S_4$ of 1, the flip flop circuit 203*c* produces a binary output of O through its $\overline{Q}$-output terminal and supplies it to the AND circuit 203*b* which in turn then supplies a binary output of O to the P term control command generating circuit 203*d* to interrupt the operation of the same.

On the other hand, when the engine is in such a particular operating condition, as already mentioned by reference to FIG. 3, the pulse motor driving signal generator 211 of the pulse motor driving circuit A is supplied with the signal $S_{10}$ from the comparator 210 in FIG. 3, which corresponds in value to a preset value outputted from the preset register 206 in FIG. 3, which is selected on the basis of the particular engine operating condition concerned, and accordingly the pulse motor 13 is held at a corresponding preset position. The air/fuel ratio control in open loop mode is effected by thus holding the pulse motor 13 at the preset position.

During this open loop mode operation, when the engine condition changes from the particular operating condition to a closed loop control condition such as engine partial load, the binary signal $S_4$ outputted from the particular engine operating condition detecting circuit 205' turns O to render the I term control command generating circuit 203*g* operative. This circuit 203*g* then supplies an I term control command signal $S_{51}'$ in the form of pulses corresponding in value to the engine rpm signal Ne to the pulse motor driving circuit A via the AND circuit 203*f*, which then drives the pulse motor 13 with I term correction. More specifically, on this occasion, the AND circuit 203*f* is supplied with a binary signal of 1 via the inverter 203*e* at its input terminal other than its input terminal connected to the circuit 203*g* as described later. Therefore, it supplies output pulses $S_{51}$ corresponding in number to the output pulses $S_{51}'$ of the I term control command generating circuit 203, to the pulse motor driving circuit A.

On the other hand, so long as the output voltage of the $O_2$ sensor 28 remains unchanged between the higher level and the lower level, the inversion detecting circuit 203*a* produces a binary output of O (that is, no output pulse is produced from the circuit 203*a*) and accordingly the AND circuit 203*b* produces a binary output of O to thus keep the P term control command generating circuit 203*d* inoperative. When there is a change in the $O_2$ sensor output voltage between the higher level and the lower level, the output of the comparator COMP is turned over so that the inversion detecting circuit 203*a* then applies an output pulse of 1 to the AND circuit 203*b* as well as to the R-input terminal of the flip flop circuit 203*c*. The resulting output of 1 of the AND circuit 203*b* renders the P term control command generating circuit 203*d* operative to supply its output signal $S_{52}$ to the pulse motor driving circuit A. At the same time, the inverted output of the comparator COMP is also applied to the input terminal A' of the pulse motor driving circuit A which then reverses the driving direction of the pulse motor 13. While the P term control command generating circuit 203*d* is thus operative, the output of the AND circuit 203*f* is kept at the level of 0 due to the action of the inverter 203*e* which inverts the output of 1 from the AND circuit 203*b* so that the output signal of the I term control command generating circuit 203*g* is not supplied to the pulse motor driving circuit A.

As noted above, the inversion detecting circuit 203*a* is adapted to produce an output pulse of 1 for actuation of the P term control command generating circuit 203*d* only when the output of the comparator COMP is inverted upon a change in the output voltage of the $O_2$ sensor between the higher level and the lower level. While the $O_2$ sensor output voltage only varies on the higher level alone or on the lower level alone to keep the output of the comparator COMP from being inverted, the output of the inversion detecting circuit 203*a* is kept at the level of 0. Therefore, after the inversion of the output of the comparator COMP, the P term control command generating circuit 203*d* is again rendered inoperative to prohibit execution of the P term control. Whilst, the I term control command generating circuit 203*g* then supplies output pulses to the pulse motor driving circuit A via the AND circuit 203f to carry out the I term control. In this manner, immediately after changeover from open loop mode to closed loop mode, the air/fuel ratio feedback control is initiated with I term correction, followed by alternate repetition of P term correction upon inversion of the output of the comparator COMP and I term control so long as there is no inversion of the above output.

What is claimed is:

1. An air/fuel ratio feedback control system for performing feedback control of the air/fuel ratio of an air/fuel mixture being supplied to an internal combustion engine, which comprises: an $0_2$ sensor for detecting the concentration of oxygen in exhaust gases emitted from said engine; fuel quantity adjusting means for producing said mixture being supplied to the engine; and an electrical circuit operatively connecting said $O_2$ sensor with said fuel quantity adjusting means in a manner effecting feedback control operation to control the air/fuel ratio of said mixture to a predetermined preset value selectively by proportional term control and by integral term control in response to an output signal produced by said $O_2$ sensor; said electrical circuit comprising in combination: a comparator for comparing the value of said output signal of said $O_2$ sensor with a predetermined reference value; a circuit responsive to an output produced by said comparator to produce a first command signal for executing proportional term control upon inversion of said output of said comparator, and a second command signal for executing integral term control when said output of said comparator remains at a certain range level; means for detecting predetermined operating conditions of said engine; means responsive to an output of the detecting means indicative of the occurrence of one of said predetermined operating conditions of said engine to interrupt said feedback control operation; and means responsive to an output of said detecting means indicative of the extinction of said one predetermined engine operating condition to cause said command signal output circuit to produce said second command signal.

* * * * *